United States Patent [19]

Yim

[11] Patent Number: 4,620,682

[45] Date of Patent: Nov. 4, 1986

[54] GOLF BAG STAND

[76] Inventor: Byung D. Yim, 21 French Creek Dr., Rochester, N.Y. 14618

[21] Appl. No.: 820,474

[22] Filed: Jan. 16, 1986

[51] Int. Cl.[4] ..... A63B 55/00

[52] U.S. Cl. ..... 248/96; 280/DIG. 6

[58] Field of Search ..... 248/96, 170, 171, 168, 248/169, 409, 408; 280/47.18, DIG. 6, 646; 206/315.2, 315.3

[56] References Cited

U.S. PATENT DOCUMENTS

| | | | |
|---|---|---|---|
| 846,552 | 3/1907 | Collins et al. | 248/96 |
| 2,661,174 | 12/1953 | Sands | 248/96 |
| 2,661,175 | 12/1953 | Holder | 248/96 |
| 2,672,311 | 3/1954 | Schiele | 248/96 |
| 2,751,176 | 6/1956 | Mowry | 248/96 |
| 3,195,844 | 7/1965 | Roepke | 248/96 |
| 4,113,221 | 9/1978 | Wehner | 248/408 |
| 4,506,854 | 3/1985 | Kim | 248/96 |

*Primary Examiner*—J. Franklin Foss
*Attorney, Agent, or Firm*—Martin LuKacher

[57] ABSTRACT

A stand for a golf bag has a center shaft with brackets to which the bag may be attached. Legs are pivotally mounted to the center shaft and are connected to a U-shaped spring which extends below the shaft, when the legs are pivoted against the shaft, so as to enable the stand and bag to be carried as a unit. When the shaft is placed on the ground, the spring is moveable upwardly and snaps the legs, automatically into extended position to form a tripod. The legs are mounted on a collar which is moveable along the shaft so as to bring the lower end of the spring away from the position where it engages the ground and prevents the legs from snapping automatically to extended position. The moveable legs and spring provide assurance that the legs will not be snapped out when the spring inadvertently hits the ground or some support service such as when the bag and stand are placed on a golf cart.

5 Claims, 6 Drawing Figures

GOLF BAG STAND

DESCRIPTION

The present invention relates to an improvement in stands for golf bags and the like of the type which automatically forms a self-supporting tripod for the bag when placed on the ground. The invention is especially suitable for use in an automatically opening and closing golf bag stand of the type which is used to carry light golf bags (so-called Sunday bags).

Sunday bag stands which automatically form a tripod when stood on the ground have come into use. Golf bags are attached to the stands and carried therewith. When the stand and bag are placed on the ground, as when the golfer is taking a golf shot, the bag has legs which are attached to a spring which automatically moves the legs outwardly to form a tripod. Oftentimes it is necessary or desirable to use a golf cart when playing a round of golf. In such an instance, when the bag and stand are placed on the cart, the spring is engaged and causes the legs to snap into open position. This either causes the bag and stand to fall off the cart, interferes with the placement of other bags on the cart or projects outwardly from the cart. Then the legs can drag on the ground or hit a bystander or some other object.

It is the principal object of the present invention to improve bag stands of the type which are carried with the bag and have springs which automatically snap legs into extended position so as to prevent automatic extension action when such action is not desired.

It is a further object of the present invention to provide a golf bag stand of the type having legs, which automatically spring into outward position when the bag is placed down on a solid object such as the ground, and which may selectably be conditioned to provide for such automatic snap out action or to prevent such action.

It is a still further object of the present invention to provide a tripod golf bag stand with legs which are automatically snapped into bag supporting position which is adapted for use on golf carts by positioning the legs and snap-out mechanism so as to prevent the automatic extension of the legs.

Briefly described, the invention may be used in a stand for a golf bag or the like having a shaft to which the bag is secured. The stand has legs pivotally mounted to the shaft to form a tripod with a shaft. The stand also has a U-shaped spring having spring arms forming the bottom of the U-shape thereof at one end and connected to different ones of the legs at the opposite ends thereof. The spring is moveably mounted on the shaft near the U-shaped end thereof. The legs are mounted on a collar which is moveably mounted on the shaft. Means are provided for selectively fixing the collar to the shaft at least first and second positions, where the U-shaped bottom of the spring projects substantially beyond the end of the shaft and where the U-shaped bottom does not project substantially beyond the end of the shaft, respectively. When in the second position, the spring is prevented from automatically extending the legs to form the tripod when the shaft is disposed in contact with the ground or other support surface, such as the deck of a golf cart.

The foregoing and other objects, features and advantages of the invention as well as presently preferred embodiments thereof will become more apparent from a reading of the following description in connection with the accompanying drawings in which.

Figure 1:
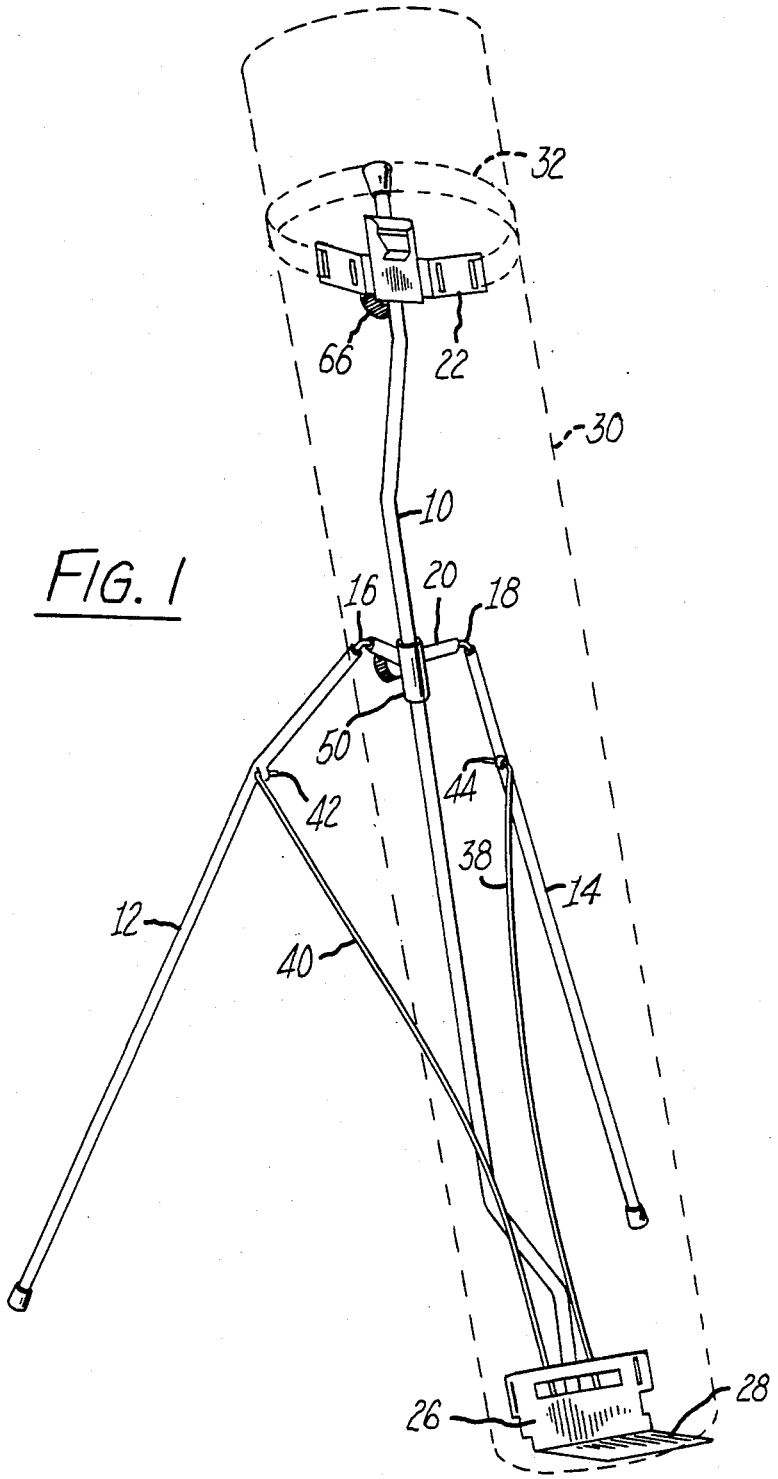
FIG. 1 is a perspective view from the front illustrating a golf bag stand embodying the invention.
Figure 2:
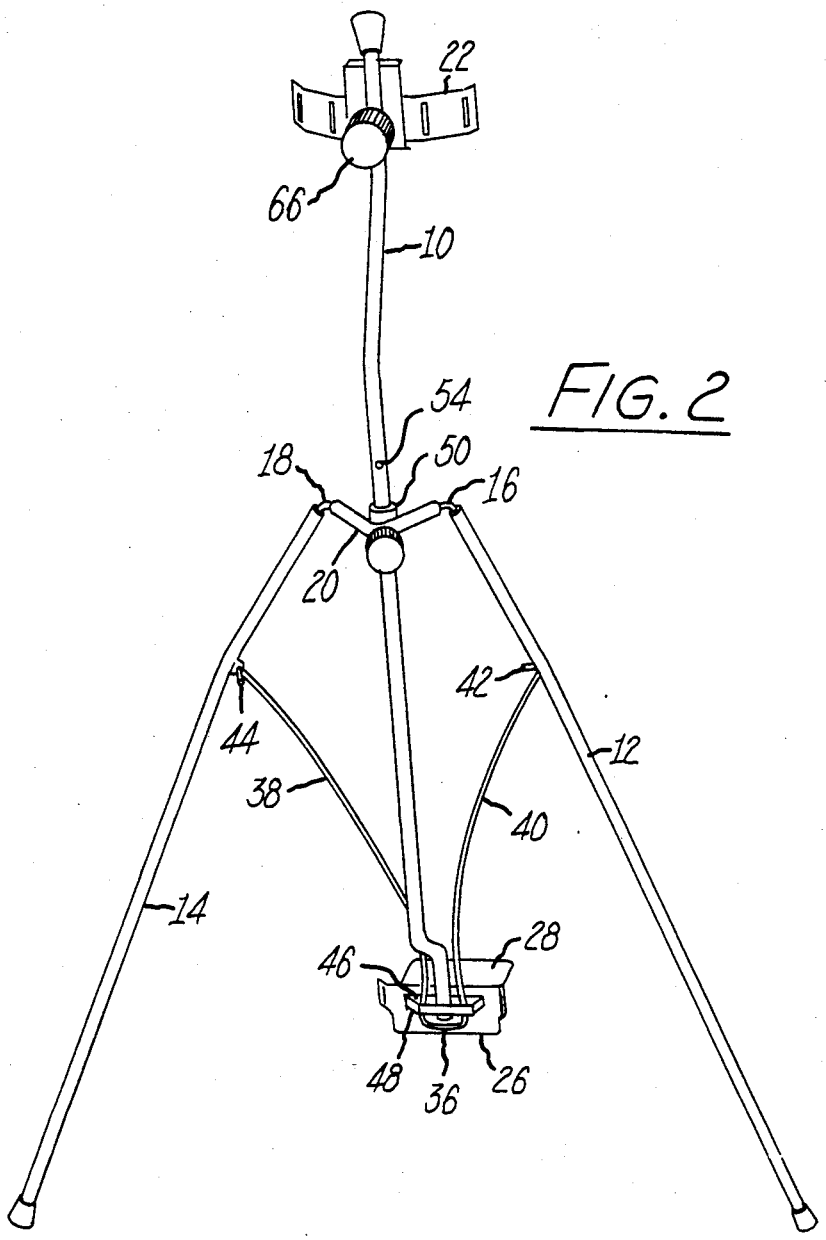
FIG. 2 is a perspective view from the rear of the golf bag stand illustrated in FIG. 1.

Referring more particularly to FIGS. 1 and 2 of the drawings, there is shown a golf bag stand embodying the invention in extended position, forming a tripod from a center shaft 10 and legs 12 and 14, which are pivotally mounted to the shaft 10 at joints 16 and 18 provided by bent pins attached to the legs 12 and 14 and inserted into a wing shaped tube 20. The center shaft has a bracket 22 at the top thereof and a bracket 26 at the bottom thereof. The bracket 26 has a plate 28 which may be pivotally connected thereto and swung out horizontally so as to support the base of the golf bag. A strap extending through slots in the upper bracket 22 may be used to attach the upper end of the golf bag to the center shaft. The upper bracket may be adjustably positioned to fit different bags of various length. The bag and strap are shown in phantom at 30 and 32, respectively, in FIG. 1.

The legs are pivoted automatically into extended position by a U-shaped spring 34 having its closed U-shaped end 36 at the bottom from which arms 38 and 40 extend. The upper ends 42 and 44 of the arms are pivotally mounted in openings in the legs 12 and 14. The U-shaped end 36 is moveably mounted in a guide opening 46 formed by pressing out a strip 48 of the lower bracket 26. The wing-shaped tube 20 is connected to a collar 50 as by welding, as may be observed in FIG. 5. This collar is of larger diameter than the shaft 10 and is moveable between a lower position defined by a hole 52 on the shaft 10 (see FIG. 4) and to an upper position defined by a hole 54. Both holes 52 and 54 extend transversely through a wall of the tube which provides the shaft and need not extend entirely through the shaft.

Figure 5:
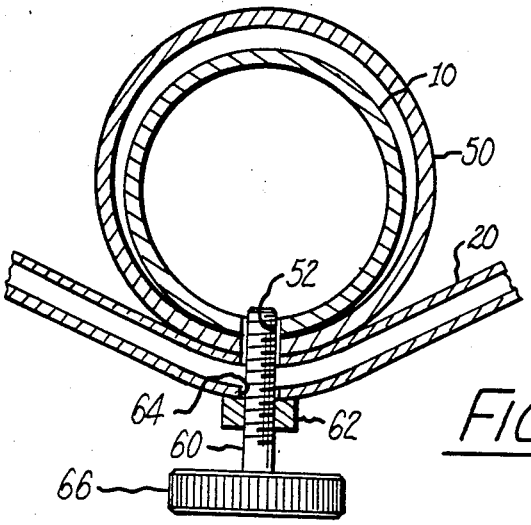
FIG. 5 is a sectional view showing one embodiment of the apparatus for positioning the legs and spring assembly of the stand. The section being a fragmentary section taken generally along the line 5—5 in FIG. 3.

As shown in FIG. 5, a threaded pin or screw 60 is screwed onto a nut 62 which is attached, as by welding, to the wing-shaped tube. The hole 52 is coaxial with holes 64 in the wing-shaped tube 20 and in the collar 50. The threaded pin is connected to a knob 66 by screwing the pin out of the nut 62 sufficiently to clear the shaft 10, the collar and the assembly of legs 12 and 14 and spring 34 may be moved between the upper and lower positions. The assembly is secured and fixed to the shaft in the selected position merely by screwing in the pin so that it extends into the hole 52 or the hole 54.

Figure 6:
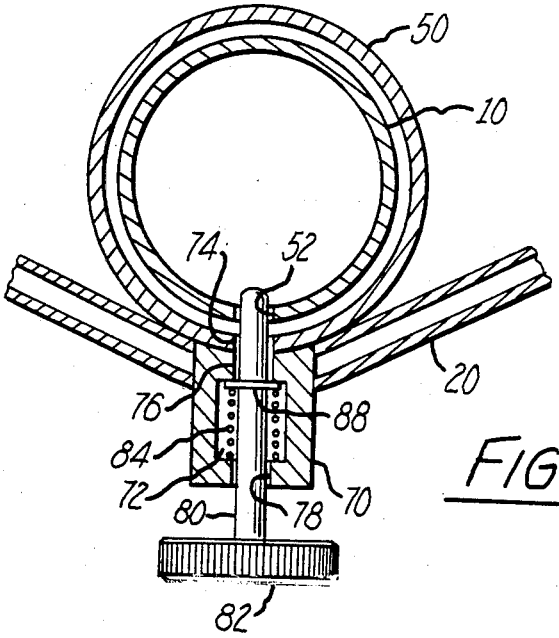
FIG. 6 is a fragmentary sectional view similar to FIG. 5 showing another embodiment of the position fixing mechanism.

Alternatively, as shown in FIG. 6, the collar 50 may be attached to a boss 70 as by welding. The boss has an opening 72 therein of larger diameter than holes 74 in the collar and 76 and 78 in the boss. A pin 80 extends through these holes. This pin may be attached to a knob 82. A helical spring 84 is disposed in the opening 72 around the pin 80. A E-washer 88 is attached, as to a groove in the pin 80. The spring therefore is engageable with the pin or with the inside wall of the opening 72 in the boss 70. The spring normally biases the pin inwardly so that it stays engaged with whatever hole 52 or 54 is selected. By pulling the knob and pin outwardly, the collar and the entire assembly of legs 12 and 14 and spring 34 may be moved into the upper or lower position.

Figure 3:
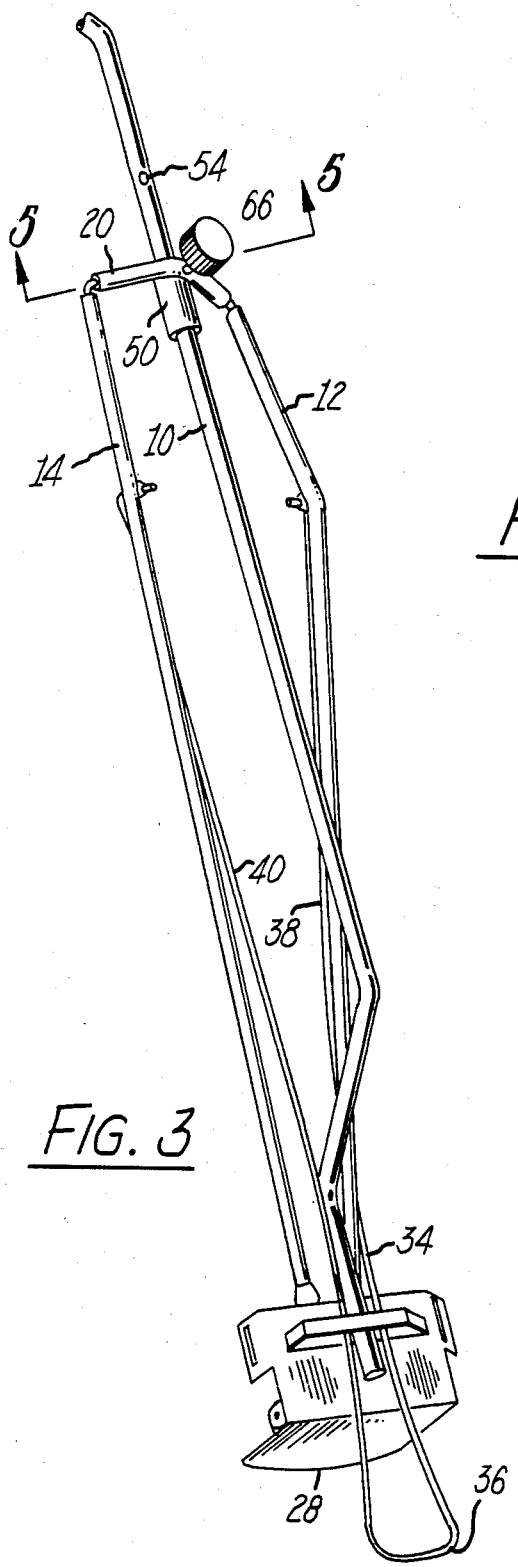
FIG. 3 is a perspective view of the golf bag stand from the rear with the assembly of legs and spring disposed for automatic activation into a tripod position when the stand is placed on the ground or other support surface.
Figure 4:
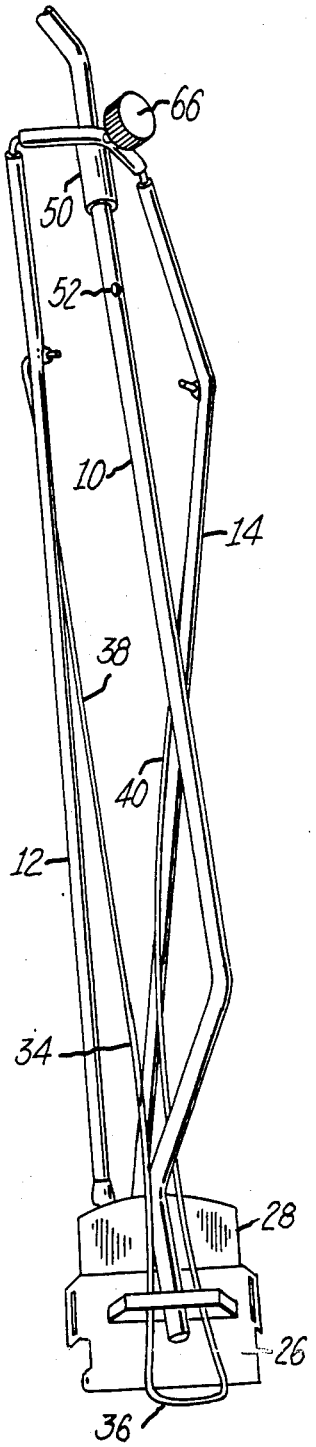
FIG. 4 is a view similar to FIG. 3 with the assembly of legs and spring disposed in a second position so as to prevent the legs from automatically being activated to form a tripod and enabling the bag to be stowed on golf carts or the like without fear of the legs extending automatically.

When in the lower position, as shown in FIG. 3, the U-shaped end 36 of the spring extends well beyond the shaft 10. Thus when the bag is placed on the ground or other support surface the legs will be snapped outwardly to automatically form a tripod support. In the upper position as shown in FIG. 4, the bottom of the spring 34 does not extend sufficiently below the bottom of the shaft to enable the spring 34 to snap the legs 12 and 14 outwardly to form the tripod support. Accordingly, when in the FIG. 4 position, the stand and the bag can be placed on a golf cart or other surface without fear that the legs will automatically extend.

From the foregoing description it will be apparent that there has been provided an improved stand for a golf bag or the like. Variations and modifications in the herein described embodiment, within the scope of the invention, will undoubtably suggest themselves to those skilled in the art. For example, instead of holes in the shaft to define the positions, the holes may be eliminated and the screw pin (60 FIG. 5) used as a set screw with the inner end thereof holding the collar in position by applying sufficient frictional force to the shaft outer surface. Accordingly the foregoing description should be taken as illustrative and not in a limiting sense.

I claim:

1. In a stand for a golf bag or the like having a shaft to which the bag is secured, legs pivotally mounted to the shaft to form a tripod with the shaft, and a U-shaped spring having spring arms forming the bottom of the U-shape of the spring at one end and each arm connected to a different one of said legs at the opposite end thereof, said spring being moveably mounted on said shaft near said opposite end, the improvement comprising a collar moveably mounted on said shaft, means for selectively fixing said collar to said shaft at at least a first and a second position where the bottom of said spring projects substantially beyond the end of said shaft and where the bottom of said spring does not project substantially beyond the said shaft, respectively, whereby to prevent said spring from automatically extending said legs to form said tripod when said shaft and the bottom of said spring is placed in contact with the ground or other support surface.

2. The improvement as set forth in claim 1 wherein said fixing means provides a threaded hole attached to said collar, said threaded hole extending transversely to said shaft, a screw having a knob at one end thereof, said screw being threadedly received in said hole for locking said collar at said position.

3. The improvement as set forth in claim 1 wherein said fixing means comprises first and second holes extending transversely into said shaft at said first and second positions, and a pin moveably mounted in said collar and selectively insertable in said first and second holes.

4. The improvement according to claim 3 wherein a boss extends from said collar having an opening therein, a hole through said boss and said collar, said hole being of smaller diameter than said opening and in larger diameter than said pin, a helical spring in said opening disposed around said pin and engageable with said boss for biasing said pin in a direction towards said shaft and holding said pin in the selected one of said holes in said shaft.

5. The improvement according to claim 4 wherein the end of said pin opposite to the end thereof which is received in said hole extends outwardly of said boss away from said collar, and a knob on the outwardly extending end of said pin.

* * * * *